US006948415B2

(12) United States Patent
Matthews et al.

(10) Patent No.: US 6,948,415 B2
(45) Date of Patent: Sep. 27, 2005

(54) SYSTEM FOR ATTACHING A NOISE SUPPRESSOR TO A FIREARM

(75) Inventors: John W. Matthews, Newport Beach, CA (US); Brooke C. Smith, Aliso Viejo, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/703,971

(22) Filed: Nov. 6, 2003

(65) Prior Publication Data

US 2005/0115394 A1 Jun. 2, 2005

(51) Int. Cl.[7] ..... F41A 21/00

(52) U.S. Cl. ..... 89/14.4; 89/14.2; 42/1.06; 42/90

(58) Field of Search ..... 42/90, 1.06; 89/14.2–14.6

(56) References Cited

U.S. PATENT DOCUMENTS

| | | | | |
|---|---|---|---|---|
| 1,054,434 A | | 2/1913 | Maxim | |
| 1,143,814 A | | 6/1915 | De Vries | |
| 1,354,416 A | | 9/1920 | Oliver | |
| 1,872,048 A | | 8/1932 | Thomas, Jr. | |
| 2,712,193 A | | 7/1955 | Mathis | |
| 2,807,112 A | | 9/1957 | Garand | |
| 2,953,972 A | | 9/1960 | Sorensen | |
| 3,075,792 A | | 1/1963 | Franck | |
| 3,385,613 A | | 5/1968 | McCall | |
| 3,698,747 A | | 10/1972 | Wing et al. | |
| 4,429,614 A | | 2/1984 | Tocco | |
| 5,092,223 A | * | 3/1992 | Hudson | 89/14.2 |
| 5,356,183 A | | 10/1994 | Cole | |
| 5,433,133 A | * | 7/1995 | La France | 89/14.2 |
| 5,773,746 A | * | 6/1998 | Vaden | 89/14.4 |
| 6,216,578 B1 | | 4/2001 | Ledys et al. | |
| 6,276,251 B1 | | 8/2001 | Downing et al. | |
| 6,385,891 B1 | | 5/2002 | Rabatin | |
| 6,412,389 B2 | | 7/2002 | Fluhr | |
| 6,450,079 B1 | | 9/2002 | Bourdin et al. | |
| 6,516,698 B1 | | 2/2003 | Poff, Jr. | |

FOREIGN PATENT DOCUMENTS

GB 2 242 476 A 10/1991

* cited by examiner

*Primary Examiner*—J. Woodrow Eldred
(74) *Attorney, Agent, or Firm*—David Weiss

(57) ABSTRACT

An apparatus and method for easily, quickly and reliably attaching a noise suppressor or other auxiliary device to the muzzle end of a firearm barrel, and in particular to a flash suppressor affixed to the muzzle end of the firearm, and for easily, quickly and reliably removing the noise suppressor or other auxiliary device therefrom.

87 Claims, 2 Drawing Sheets

SYSTEM FOR ATTACHING A NOISE SUPPRESSOR TO A FIREARM

BACKGROUND OF THE INVENTION

This invention relates to firearms, and more particularly to systems for removably attaching a noise suppressor or other auxiliary device to the muzzle of a firearm barrel.

Various systems are known in the firearms art for attaching a noise suppressor to a firearm, and specifically for removably attaching a noise suppressor to a flash suppressor affixed to the muzzle end of a firearm. There nevertheless exists a need for improving such systems, particularly for increasing the ease by which a user may attach a noise suppressor to a flash suppressor while at the same time effecting a reliable securement therebetween capable of withstanding the vibrations incidental to the firing of such firearms as automatic rifles used by military personnel.

SUMMARY OF THE INVENTION

The present invention provides an apparatus and method for easily, quickly and reliably attaching a noise suppressor or other auxiliary device to the muzzle end of a firearm barrel, and for easily and quickly removing such device therefrom. In a preferred embodiment of the invention, a noise suppressor is removably secured to a fixture such as a flash suppressor secured to the muzzle end of a firearm.

In general terms, the invention provides auxiliary apparatus for attachment to a firearm including a barrel having a longitudinal axis, comprising the combination of: a fixture adapted to be attached to the muzzle of the barrel coaxially therewith and including an annular ridge; and an auxiliary device having a bore for coaxially receiving the fixture, such device including a collar having an outer surface eccentric about the bore, and a ring having an annular wall rotatably secured to the outer surface of the collar, the ring including a radial wall having a circular opening eccentric relative to the annular wall, the opening being concentric relative to the bore at a first rotational position of the ring for permitting the ring to pass over the ridge, the opening being eccentric relative to the bore at a second rotational position of the ring for causing the radial wall to block passage of the ring over the ridge.

More specifically, a preferred embodiment according to the invention provides a noise suppressor apparatus for attachment to a firearm including a barrel having a longitudinal axis, comprising the combination of: a flash suppressor adapted to be attached to the muzzle of the barrel coaxially therewith and including an annular ridge; and a noise suppressor including a back section having a bore for coaxially receiving the flash suppressor, the back section including a collar having an outer surface eccentric about the bore, and a ring having an annular wall rotatably secured to the outer surface of the collar, the ring including a radial wall having a circular opening eccentric relative to the annular wall, the opening being concentric relative to the bore at a first rotational position of the ring for permitting the ring to pass over the ridge, the opening being eccentric relative to the bore at a second rotational position of the ring for causing the radial wall to block passage of the ring over the ridge.

The collar preferably includes an edge about the bore engaging the ridge when the flash suppressor is received by the bore, and the ring is longitudinally translatable on the collar for urging the radial wall to engage the ridge when the flash suppressor is received by the bore. In the preferred embodiment, the annular wall of the ring is threadedly secured to the outer surface of the collar. The noise suppressor may be circumferentially indexed to the flash suppressor; for example, the noise suppressor's back section may include a radial pin for being received by a longitudinal groove in the flash suppressor, such as a notch in the forward edge of the flash suppressor.

The preferred embodiment of the noise suppressor apparatus includes a locking device associated with the ring and with the noise suppressor's back section for releasably locking the ring in its second rotational position, as well as for releasably retaining the ring in its first rotational position. The locking device may include a locking bar affixed to the back section and having a pawl, and ratchet teeth on the ring engaging the pawl when the ring is in its second rotational position for locking the ring in that position. A manually operable actuator on the locking bar releases the pawl from engagement with the ratchet teeth so that the ring may be placed in its first rotational position when it is desired to remove the noise suppressor from the flash suppressor.

The locking bar may further include a second pawl for cooperating with the ratchet teeth when the ring is in its first rotational position, for releasably retaining the ring in that position. The apparatus preferably further includes a stop on the noise suppressor's back section, the stop cooperating with the ring for restricting rotation of the ring between its first rotational or open position and its second rotational or lock position.

According to another aspect of the present invention, a method is provided of attaching an auxiliary device to the barrel of a firearm having a longitudinal axis, comprising: providing an annular ridge on a forward portion of the barrel; providing a noise suppressor including a bore and a collar having a threaded outer surface eccentric about the bore, the ring having an annular wall threaded onto the outer surface of the collar, the ring including a radial wall having a circular opening eccentric relative to the annular wall; rotating the ring on the collar until the opening is concentric relative to the bore at a first rotational position of the ring for permitting the ring to pass over the ridge; placing the auxiliary device to the firearm with the barrel's forward portion received by the bore; and threading the ring on the collar until the opening is eccentric relative to the bore at a second rotational position for causing the radial wall to block passage of the ring over the ridge. The auxiliary device may be removed from the firearm barrel by unthreading the ring on the collar until the ring is at its first rotational position; and longitudinally withdrawing the auxiliary device from the forward portion of the barrel.

In a preferred embodiment of the method, the annular ridge is provided on the barrel by providing a flash suppressor with an annular ridge and by coaxially affixing the flash suppressor to the muzzle of the barrel, and the auxiliary device comprises a noise suppressor.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
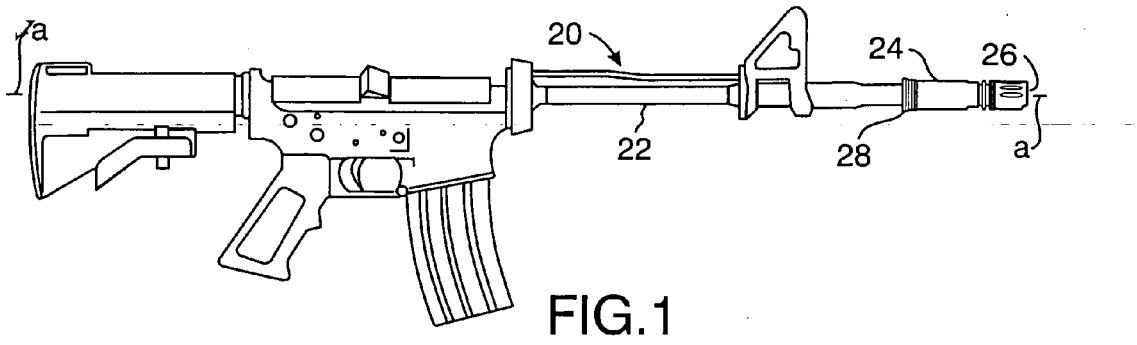
FIG. 1 is a side view of a firearm equipped with a flash suppressor including features of a preferred embodiment of the present invention.
Figure 2:
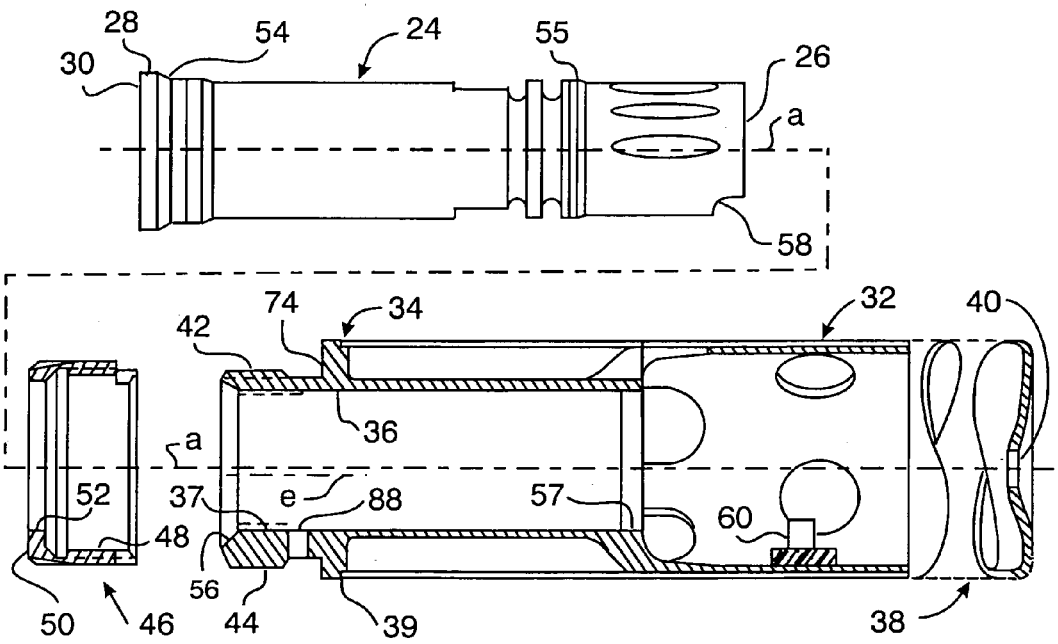
FIG. 2 is an exploded side view of components of a preferred embodiment of apparatus for attaching a noise suppressor to a firearm, shown partially in cross-section and partially fragmented.
Figure 3:
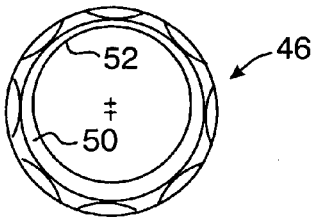
FIG. 3 is a rear view of the retainer ring component shown in FIG. 2.
Figure 10:
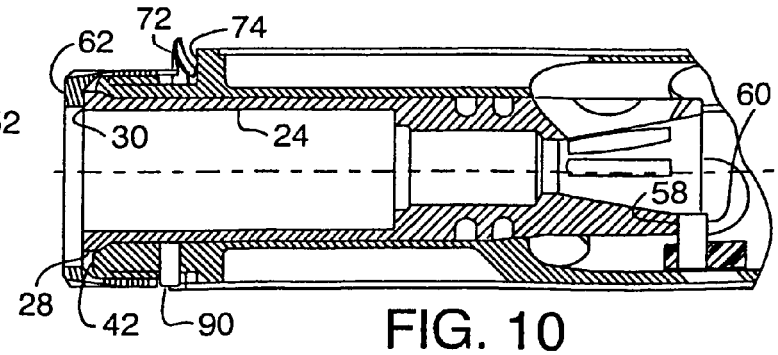
FIG. 10 is a cross-sectional view of a fragment of the noise suppressor back section with locking retainer ring of FIG. 7, taken along the line 10—10 of FIG. 7 and viewed in the direction of the appended arrows.

Turning first to FIGS. 1–6, there is illustrated in FIG. 1 an example of a firearm 20, such as an M-4 or M-16 automatic rifle, to which a firearm accessory, in particular a noise suppressor according to the present invention, may be removably secured. The firearm 20 includes a barrel 22 having a longitudinal axis a along which a fired bullet is caused to travel. A generally tubular fixture 24—such as a flash suppressor, muzzle brake or muzzle compensator—is secured to the barrel's muzzle along the longitudinal axis a, the fixture 24 having a forward opening 26 through which the fired bullet exits. The tubular fixture 24 shown in the drawings of FIGS. 1, 2 and 10 is a flash suppressor 24 which is fixedly secured to the firearm barrel 22 such as by welding or other conventional securement means (for example, by means of mating threads externally about the barrel muzzle and internally of the flash suppressor together with a high temperature cement or a locking device for preventing rotation of the installed flash suppressor 24 with respect to the firearm barrel 22). In the drawings other than FIG. 1, the firearm barrel 22, to which the flash suppressor 24 is secured, is not shown for purposes of clarity of description.

In the preferred embodiment according to the present invention, the flash suppressor 24 is provided with an external annular ridge 28 preferably along the flash suppressor's annular rear end 30, although the annular ridge 28 may be included as a part of the exterior surface of the firearm barrel 22.

As used herein, the word "front" or "forward" corresponds to the firing direction of the firearm 20 (i.e., to the right as shown in FIGS. 1, 2, 7 and 10); "rear" or "rearward" or "back" corresponds to the direction opposite the firing direction of the firearm 20 (i.e., to the left as shown in FIGS. 1, 2, 7 and 10); "longitudinal" means the direction along or parallel to the longitudinal axis a of the barrel 22 of the firearm 20 or of the flash suppressor 24 or of the noise suppressor body 32; and "transverse" means a direction perpendicular to the longitudinal direction.

The noise suppressor body 32 includes a back section 34 having a longitudinal bore 36 for coaxially receiving the flash suppressor 24. The noise suppressor body 32 further includes a sound suppressing front section 38 fixedly secured to the back section 34 (for example by welding along their circumferences as at 39) including a front end having an axial opening 40 through which a fired bullet exits when the noise suppressor body 32 is secured to the firearm barrel 22. Noise suppressing sections of firearm noise suppressors are well known in the firearms art.

Figure 4:
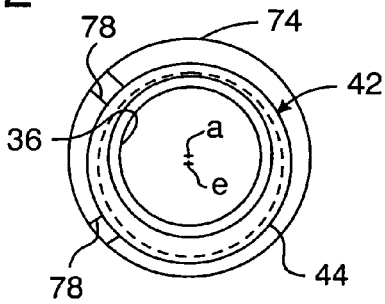
FIG. 4 is a rear view of the noise suppressor back section shown in FIG. 2.

The back section 34 of the noise suppressor body 32 includes a rear collar 42 having an inner surface 37 along the longitudinal bore 36 and an outer threaded surface 44 which is eccentric about the bore 36, i.e. the outer circular surface 44 of the collar 42 is centered about an axis e parallel to and spaced from the longitudinal axis a (see FIGS. 2 and 4).

A retainer ring 46 having an internally threaded annular wall 48 is threadedly secured to the externally threaded outer surface 44 of the collar 42. The retainer ring 46 includes a transverse or radial wall 50 having a circular opening 52 eccentric relative to the annular wall 48. When the retainer ring 46 is threaded upon the eccentric outer surface 44 of the collar 42, the circular opening 52 is concentric relative to the bore 36 at a first rotational position of the ring 46 relative to the outer surface 44 of the collar 42, and the circular opening 52 is eccentric relative to the bore 36 at a second rotational position of the ring 46 relative to the outer surface 44 of the collar 42. In the preferred embodiment, the rotation of the ring 46 between its first and second rotational positions is about one-half revolution or approximately 180°.

When installing the noise suppressor 31 onto the firearm barrel 22, the engagement of the retaining ring 46 onto the collar 42 is such that the ring 46 is at its first rotational position wherein the opening 52 is concentric relative to the bore 36. The diameter of the bore 36 is slightly greater than the outside diameter of the tubular flash suppressor 24 but is slightly less than the diameter of the annular ridge 28 on the flash suppressor 24, and the diameter of the circular opening 52 through the rear radial wall 50 of the ring 46 is slightly greater than the diameter of the annular ridge 28. In one example, the flash suppressor 24 had a tubular outside diameter of approximately 0.864 inch and a ridge diameter of approximately 0.987 inch; the bore 36 of the back section 34 had a diameter of approximately 0.906 inch, and the outer surface 44 of the collar 42 had a diameter of approximately 1.25 inch about center axis e spaced from the longitudinal axis a by approximately 0.050 inch; and the retainer ring 46 had a circular opening 52 of diameter approximately 1.020 inch with a center spaced approximately 0.050 inch from the center of the ring's annular wall 48.

To install the noise suppressor (comprising the noise suppressor body 32 and the retainer ring 46) onto the firearm barrel 22, the noise suppressor body 32 with the retainer ring 46 secured to the collar 44 in the first rotational position as described above, is placed rearwardly onto the barrel's muzzle end such that the flash suppressor 24 is longitudinally received by the back section bore 36 through the ring opening 52, until the front edge 54 of the annular ridge 28 engages the rear edge 56 of the collar 42 about the bore 36, and with an annular external surface 55 toward the forward end portion of the flash suppressor 24 engaging an annular internal surface 57 of the noise suppressor back section 34.

The edges 54, 56 may be configured with complementary bevels for implementing mating contact thereof. At the same time, the noise suppressor is rotationally adjusted with respect to the barrel 22 for circumferentially indexing the noise suppressor body 32 to the barrel 22 and for preventing rotation of the noise suppressor body 32 with respect to the barrel, for example by means of a longitudinal channel, such as a forwardly facing notch 58 at the front edge of the flash suppressor 24, receiving a radially disposed indexing pin 60 internally secured to the noise suppressor back section 34, as shown in FIGS. 2 and 10.

Figure 5:
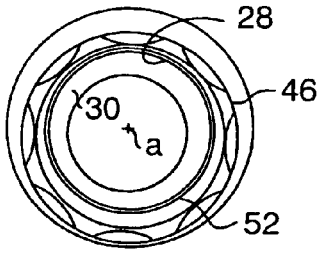
FIG. 5 is a rear view of the assembled components of FIG. 2 in an open condition permitting the noise suppressor to be installed to or removed from the flash suppressor.

At this point during installation, the circular opening 52 of the retainer ring 46, being concentric with the ridge 28 and having a diameter slightly greater than the diameter of the ridge 28, permits the ring 46 to longitudinally pass over the flash suppressor's annular ridge 28 as shown in FIG. 5. After such passage, installation proceeds by threadedly rotating the ring 46 upon the outer surface 44 of the collar 42, with the resulting eccentric rotation of the circular opening 52 of the radial wall 50 to place a segment or portion 62 of that radial wall 50 directly rearward of a portion of the annular ridge 28 of the flash suppressor 24. At the same time, such threaded rotation causes the ring 46 to forwardly translate such that the forward surface of the portion 62 of the radial wall 50 contacts that portion of the annular ridge 28 of the flash suppressor 24. Accordingly, the interfering portion 62 of the radial wall 50 blocks forward longitudinal passage of the ring 46 over the annular ridge 28.

Figure 6:
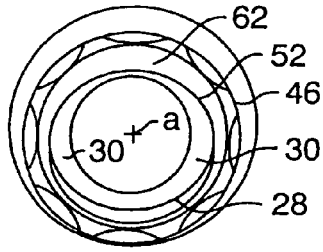
FIG. 6 is a view similar to FIG. 5, except that the apparatus is in a condition blocking removal of the noise suppressor from the flash suppressor.

Upon such installation, the noise suppressor is fixedly secured to the flash suppressor 24 (and hence to the barrel 22) both longitudinally and rotationally. In the disclosed example of the preferred embodiment, the rotation from the open or unsecured configuration shown in FIG. 5 to the secured configuration shown in FIG. 6 is optimally approximately 180° or approximately one-half turn, although it may be appreciated that securing interference commences at substantially lesser rotation.

To remove the noise suppressor from the firearm barrel 22, the retainer ring 46 is rotated in the reverse or unthreading direction to its first rotational position as shown in FIG. 5, whereupon the circular opening 52 is concentric relative to the bore 36, thereby permitting the ring 46 to be passed over the annular ridge 28. The back section 34 with attached ring 46 may thereupon be forwardly longitudinally withdrawn from the flash suppressor 24 and the barrel 22 when the noise suppressor body 32 is moved longitudinally forwardly.

The apparatus according to the present invention preferably includes a locking device to lock the retainer ring 46 in its second rotational position with the forward surface of the blocking portion 62 of the radial wall 50 rearwardly engaging the annular ridge 28. An example of such locking device is shown in FIGS. 7–12.

The forwardly facing edge of the internally threaded annular wall 48 of the retainer ring 46 includes a longitudinally projecting segment 64 between a first end 66 and a second end 68. The segment 64 includes a series of ratchet teeth 70 adjacent to the first end 66. For example, the segment 64 may extend over an arc of say approximately 150° of which say approximately 35° includes the ratchet teeth 70.

Figure 9:
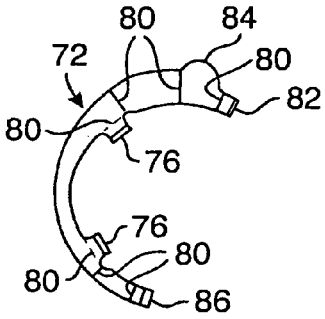
FIG. 9 is a plan view of a locking bar component of the locking device shown in FIG. 7.
Figure 12:
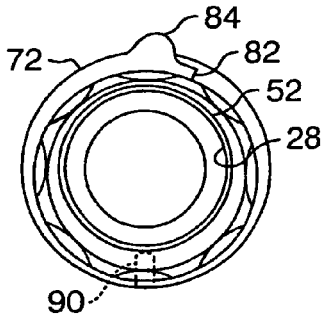
FIG. 12 is similar to FIG. 11, except that the assembled components are shown in the open condition.
Figure 11:
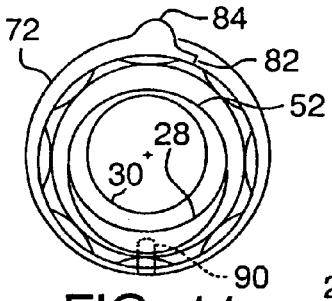
FIG. 11 is a rear view of the assembled components of FIG. 10, shown in the locked condition.

A locking bar 72 is affixed to the rear flange 74 of the noise suppressor body 32, such as by means of radially extending tabs 76 of the locking bar 72 snapped into radial channels 78 in the rearwardly facing surface of the flange 74 (see FIGS. 9 and 4). The locking bar 72 may be fabricated of a somewhat flexible plate such as steel and is bent along lines 80. A pawl 82 at one end of the locking bar 72 cooperates with the ratchet teeth 70 when the ring 46 is in its second rotational position for locking the ring 46 against unthreading rotation, thereby preventing undesired movement and removal of the noise suppressor 31 from the firearm barrel 22.

The locking bar 72 includes a manually operable actuator for unlocking the ring 46, such as a radially extending pad 84 adjacent to the pawl 82, which pad 84 may be urged forwardly (for example by a user's thumb) for disengaging the pawl 82 from the ratchet teeth 70. A second pawl 86 at the other end of the locking bar 72 engages the ratchet teeth 70 when the ring 46 is in its first rotational position, for releasably restraining rotation of the ring 46 from its first position.

Figure 7:
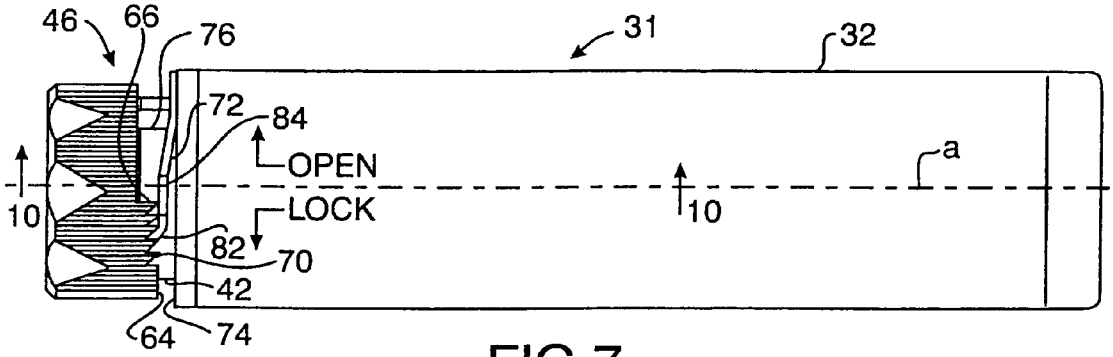
FIG. 7 is a top plan view of the assembled components of FIG. 2, including a locking device.
Figure 8:
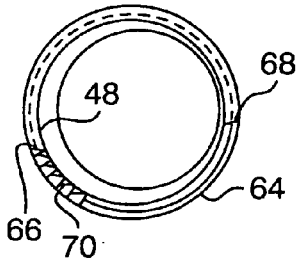
FIG. 8 is a front view of the locking retainer ring shown in FIG. 7.

When installing the locking retainer ring 46 to the collar 42, the ring 46 is threadedly rotated upon the threaded collar 42 (in the clockwise direction as viewed from the rear, i.e. from the left side of FIG. 7) until the first end 66 passes over a radial bore 88 in the collar 42 (see FIG. 2) preferably at a circumferential position approximately along a radius intersecting the point of the maximum distance of the collar's annular surface 44 from the longitudinal axis a. A pin 90 is then fixedly secured into the radial bore 86, the pin 90 radially projecting from the wall 44 for stopping clockwise (threading) rotation of the ring 46 when the ring's second end 68 contacts the projecting stop pin 90 (preferably while the ring is still in its second rotational position), and for stopping counterclockwise (unthreading) rotation of the ring 46 when its first end 66 contacts the stop pin 90 (preferably at the ring's first position). The stop pin 90, situated between the ring's first and second ends 66, 68 as described, causes the ring 46 to be rotationally captive to the collar 42 between the ring's first or "open" position (shown in FIG. 12) and the ring's second or "lock" position (shown in FIGS. 10 and 11).

When installing the sound suppressor 31 (with locking device) to the firearm barrel 22, the ring 46—which is preferably maintained in its "open" position with the second pawl 86 engaging one of the ratchet teeth 70—is placed rearwardly onto the barrel's muzzle end such that the flash suppressor 24 is longitudinally received by the back section bore 36 as previously described. The user then urges the ring 46 to threadedly rotate upon the outer surface 44 of the collar 42, releasing the second pawl 86 from its engagement with the ratchet teeth 70 and placing the ring 46 is in its second rotational position whereby a portion 62 of the ring's radial wall 50 rearwardly contacts a portion of the annular ridge 28 of the flash suppressor 24. Such rotation also places the ratchet teeth 70 in operative engagement with the pawl 82, thereby locking the ring 46 against unthreading rotation, effectively locking the noise suppressor 31 to the flash suppressor 24 and the firearm barrel 22.

When it is desired to remove the noise suppressor 31 from the flash suppressor 24 and the firearm barrel 22, the user unthreadedly rotates the ring 46 while urging the pad 84 forwardly to release the pawl 82 from the ratchet teeth 70. The user continues unthreadedly rotating the ring 46 until the ring's first end 66 contacts the stop pin 90, whereupon the locking bar's second pawl 86 engages one of the ratchet teeth 70, thereby placing and maintaining the ring 46 in its first or open position shown in FIG. 12. The user thereupon longitudinally withdraws the noise suppressor 31 from the flash suppressor 24 and the firearm barrel 22.

Thus, there has been described a preferred embodiment of an apparatus for easily, quickly and reliably attaching a noise suppressor or other auxiliary device to the muzzle end of a firearm, and for easily and quickly removing the device therefrom, as well as a method for such attachment. Other embodiments of the present invention, and variations of the embodimenst described herein, may be developed without departing from the essential characteristics thereof. Accordingly, the invention should be limited only by the scope of the claims listed below.

We claim:

1. Noise suppressor apparatus for attachment to a firearm including a barrel of having a longitudinal axis, comprising the combination of:

a fixture adapted to be attached to the muzzle of the barrel coaxially therewith and including an annular ridge; and a noise suppressor including a back section having a bore for coaxially receiving said fixture, said back section including a collar having an outer surface eccentric about said bore, and a ring having an annular wall rotatably secured to said outer surface of said collar, said ring including a radial wall having a circular opening eccentric relative to said annular wall, said opening being concentric relative to said bore at a first rotational position of said ring for permitting said ring to pass over said ridge, said opening being eccentric relative to said bore at a second rotational position of said ring for causing said radial wall to block passage of said ring over said ridge.

2. The apparatus according to claim 1, wherein:

said fixture is a flash suppressor.

3. The apparatus according to claim 1, wherein:

said collar includes an edge about said bore engaging said ridge when said fixture is received by said bore.

4. The apparatus according to claim 1, wherein:

said ring is longitudinally translatable on said collar for urging said radial wall to engage said ridge when said fixture is received by said bore.

5. The apparatus according to claim 4, wherein:

said collar includes an edge about said bore engaging said ridge when said fixture is received in said bore.

6. The apparatus according to claim 1, wherein:

said ridge includes a forward surface engaging said back section when said fixture is received by said bore.

7. The apparatus according to claim 6, wherein:

said ridge includes a rear surface engaging said radial wall when said ring is at said second rotational position.

8. The apparatus according to claim 1, wherein:

said annular wall of said ring is threadedly secured to said outer surface of said collar.

9. The apparatus according to claim 1, wherein:

the diameter of said opening is greater than the diameter of said ridge.

10. The apparatus according to claim 1, wherein:

the diameter of said bore is less than the diameter of said ridge.

11. The apparatus according to claim 10, wherein:

the diameter of said opening is greater than the diameter of said ridge.

12. The apparatus according to claim 1, wherein:

said back section includes a radial pin and said fixture includes a longitudinal groove for receiving said pin when said fixture is received by said bore.

13. The apparatus according to claim 1, including:

a locking device associated with said ring and said back section for releasably locking said ring in said second rotational position.

14. The apparatus according to claim 1, including:

a stop on said back section cooperating with said ring for restricting rotation of said ring between said first rotational position and said second rotational position.

15. The apparatus according to claim 1, including:

a locking device associated with said ring and said back section for releasably retaining said ring in said first rotational position.

16. The apparatus according to claim 1, including:

a locking bar affixed to said back section and having a pawl; and ratchet teeth on said ring engaging said pawl when said ring is in said second rotational position for locking said ring in said second rotational position.

17. The apparatus according to claim 16, wherein:

said locking bar includes a manually operable actuator for releasing said pawl from engagement with said ratchet teeth.

18. The apparatus according to claim 16, wherein:

said locking bar includes a second pawl for cooperating with said ratchet teeth when said ring is at said first rotational position, for releasably retaining said ring in said first rotational position.

19. Noise suppressor apparatus for attachment to a firearm including a barrel having a longitudinal axis, comprising the combination of:

a fixture adapted to be attached to the muzzle of the barrel coaxially therewith and including an annular ridge; and a noise suppressor including a back section having a bore for coaxially receiving said fixture, said back section including a collar having an outer surface eccentric about said bore, and a ring rotatably secured to said outer surface of said collar, said ring including a radial wall having a circular opening eccentric relative to said outer surface of said collar, said opening being concentric relative to said bore at a first rotational position of said ring for permitting said ring to pass over said ridge, said opening being eccentric relative to said bore at a second rotational position of said ring for causing said radial wall to block passage of said ring over said ridge.

20. The apparatus according to claim 19, wherein:

said fixture is a flash suppressor.

21. The apparatus according to claim 20, wherein:

said collar includes an edge about said bore engaging said ridge when said flash suppressor is received by said bore.

22. The apparatus according to claim 20, wherein:

said ring is longitudinally translatable on said collar for urging said radial wall to engage said ridge when said flash suppressor is received by said bore.

23. The apparatus according to claim 22, wherein:

said collar includes an edge about said bore engaging said ridge when said flash suppressor is received in said bore.

24. The apparatus according to claim 20, wherein:

said ridge includes a forward surface engaging said back section when said flash suppressor is received by said bore.

25. The apparatus according to claim 24, wherein:

said ridge includes a rear surface engaging said radial wall when said ring is at said second rotational position.

26. The apparatus according to claim 20, wherein:

said ring is threadedly secured to said outer surface of said collar.

27. The apparatus according to claim 20, wherein:

the diameter of said opening is greater than the diameter of said ridge.

28. The apparatus according to claim 20, wherein:

the diameter of said bore is less than the diameter of said ridge.

29. The apparatus according to claim 28, wherein:
the diameter of said opening is greater than the diameter of said ridge.

30. The apparatus according to claim 20, wherein:
said back section includes a radial pin and said flash suppressor includes a longitudinal groove for receiving said pin when said fixture is received by said bore.

31. The apparatus according to claim 20, including:
a locking device associated with said ring and said back section for releasably locking said ring in said second rotational position.

32. The apparatus according to claim 20, including:
a stop on said back section cooperating with said ring for restricting rotation of said ring between said first rotational position and said second rotational position.

33. The apparatus according to claim 20, including:
a locking device associated with said ring and said back section for releasably retaining said ring in said first rotational position.

34. The apparatus according to claim 20, including:
a locking bar affixed to said back section and having a pawl; and
ratchet teeth on said ring engaging said pawl when said ring is in said second rotational position for locking said ring in said second rotational position.

35. The apparatus according to claim 34, wherein:
said locking bar includes a manually operable actuator for releasing said pawl from engagement with said ratchet teeth.

36. The apparatus according to claim 34, wherein:
said locking bar includes a second pawl for cooperating with said ratchet teeth when said ring is at said first rotational position, for releasably retaining said ring in said first rotational position.

37. Auxiliary apparatus for attachment to a firearm including a barrel having a longitudinal axis, comprising the combination of:
a fixture adapted to be attached to the muzzle of the barrel coaxially therewith and including an annular ridge; and
an auxiliary device having a bore for coaxially receiving said fixture, said device including a collar having an outer surface eccentric about said bore, and a ring having an annular wall rotatably secured to said outer surface of said collar, said ring including a radial wall having a circular opening eccentric relative to said annular wall, said opening being concentric relative to said bore at a first rotational position of said ring for permitting said ring to pass over said ridge, said opening being eccentric relative to said bore at a second rotational position of said ring for causing said radial wall to block passage of said ring over said ridge.

38. The apparatus according to claim 37, wherein:
said collar includes an edge about said bore engaging said ridge when said fixture is received by said bore.

39. The apparatus according to claim 37, wherein:
said ring is longitudinally translatable on said collar for urging said radial wall to engage said ridge when said fixture is received by said bore.

40. The apparatus according to claim 39, wherein:
said collar includes an edge about said bore engaging said ridge when said fixture is received in said bore.

41. The apparatus according to claim 37, wherein:
said annular wall of said ring is threadedly secured to said outer surface of said collar.

42. The apparatus according to claim 37, wherein:
the diameter of said opening is greater than the diameter of said ridge.

43. The apparatus according to claim 42, wherein:
the diameter of said bore is less than the diameter of said ridge.

44. The apparatus according to claim 37, wherein:
said auxiliary device includes a radial pin and said fixture includes a longitudinal groove for receiving said pin when said fixture is received by said bore.

45. The apparatus according to claim 37, including:
a locking device associated with said ring and said auxiliary device for releasably locking said ring in said second rotational position.

46. The apparatus according to claim 37, including:
a stop on said auxiliary device cooperating with said ring for restricting rotation of said ring between said first rotational position and said second rotational position.

47. The apparatus according to claim 37, including:
a locking device associated with said ring and said auxiliary device for releasably retaining said ring in said first rotational position.

48. The apparatus according to claim 37, including:
a locking bar affixed to said auxiliary device and having a pawl; and
ratchet teeth on said ring engaging said pawl when said ring is in said second rotational position for locking said ring in said second rotational position.

49. The apparatus according to claim 48, wherein:
said locking bar includes a manually operable actuator for releasing said pawl from engagement with said ratchet teeth.

50. The apparatus according to claim 48, wherein:
said locking bar includes a second pawl for cooperating with said ratchet teeth when said ring is at said first rotational position, for releasably retaining said ring in said first rotational position.

51. Auxiliary apparatus for attachment to a fixture coaxially secured to the barrel of a firearm having a longitudinal axis, the fixture including an annular ridge, the auxiliary apparatus comprising the combination of:
an auxiliary device having a bore for coaxially receiving the fixture, said device including a collar having an outer surface eccentric about said bore, and a ring rotatably secured to said outer surface of said collar, said ring including a radial wall having a circular opening eccentric relative to said outer surface of said collar, said opening being concentric relative to said bore at a first rotational position of said ring for permitting said ring to pass over the ridge, said opening being eccentric relative to said bore at a second rotational position of said ring for causing said radial wall to block passage of said ring over the ridge.

52. The apparatus according to claim 51, wherein said auxiliary device is a noise suppressor.

53. The apparatus according to claim 52, wherein the fixture is a flash suppressor.

54. The apparatus according to claim 51, wherein:
said collar includes an edge about said bore engaging said ridge when said fixture is received by said bore.

55. The apparatus according to claim 51, wherein:
said ring is longitudinally translatable on said collar for urging said radial wall to engage said ridge when said fixture is received by said bore.

56. The apparatus according to claim 55, wherein:
said collar includes an edge about said bore engaging said ridge when said fixture is received in said bore.

57. The apparatus according to claim 51, wherein:
said annular wall of said ring is threadedly secured to said outer surface of said collar.

58. The apparatus according to claim 51, wherein:
the diameter of said opening is greater than the diameter of said ridge.

59. The apparatus according to claim 58, wherein:
the diameter of said bore is less than the diameter of said ridge.

60. The apparatus according to claim 51, wherein:
said auxiliary device includes a radial pin and said fixture includes a longitudinal groove for receiving said pin when said fixture is received by said bore.

61. The apparatus according to claim 51, including:
a locking device associated with said ring and said auxiliary device for releasably locking said ring in said second rotational position.

62. The apparatus according to claim 51, including:
a stop on said auxiliary device cooperating with said ring for restricting rotation of said ring between said first rotational position and said second rotational position.

63. The apparatus according to claim 51, including:
a locking device associated with said ring and said auxiliary device for releasably retaining said ring in said first rotational position.

64. The apparatus according to claim 51, including:
a locking bar affixed to said auxiliary device and having a pawl; and
ratchet teeth on said ring engaging said pawl when said ring is in said second rotational position for locking said ring in said second rotational position.

65. The apparatus according to claim 64, wherein:
said locking bar includes a manually operable actuator for releasing said pawl from engagement with said ratchet teeth.

66. The apparatus according to claim 64, wherein:
said locking bar includes a second pawl for cooperating with said ratchet teeth when said ring is at said first rotational position, for releasably retaining said ring in said first rotational position.

67. Firearm apparatus comprising the combination of:
a firearm including a barrel having a longitudinal axis;
a fixture attached to the muzzle of said barrel coaxially therewith and including an annular ridge; and
an auxiliary device having a bore for coaxially receiving said fixture, said device including a collar having an outer surface eccentric about said bore, and a ring rotatably secured to said outer surface of said collar, said ring including a radial wall having a circular opening eccentric relative to said outer surface of said collar, said opening being concentric relative to said bore at a first rotational position of said ring for permitting said ring to pass over said ridge, said opening being eccentric relative to said bore at a second rotational position of said ring for causing said radial wall to block passage of said ring over said ridge.

68. The apparatus according to claim 67, wherein said auxiliary device is a noise suppressor.

69. The apparatus according to claim 68, wherein said fixture is a flash suppressor.

70. Firearm apparatus comprising the combination of:
a firearm including a barrel having a longitudinal axis;
an annular ridge on a forward portion of said barrel; and
an auxiliary device having a bore for coaxially receiving said forward portion of said barrel, said device including a collar having an outer surface eccentric about said bore, and a ring rotatably secured to said outer surface of said collar, said ring including a radial wall having a circular opening eccentric relative to said outer surface of said collar, said opening being concentric relative to said bore at a first rotational position of said ring for permitting said ring to pass over said ridge, said opening being eccentric relative to said bore at a second rotational position of said ring for causing said radial wall to block passage of said ring over said ridge.

71. The apparatus according to claim 70, wherein said auxiliary device is a noise suppressor.

72. A method of attaching a noise suppressor to the barrel of a firearm having a longitudinal axis, comprising:
providing a flash suppressor with an annular ridge;
coaxially affixing said flash suppressor to the muzzle of the barrel;
providing a noise suppressor including a bore and a collar having a threaded outer surface eccentric about said bore, and a ring having an annular wall threaded onto said outer surface of said collar, said ring including a radial wall having a circular opening eccentric relative to said annular wall;
rotating said ring on said collar until said opening is concentric relative to said bore at a first rotational position of said ring for permitting said ring to pass over said ridge;
placing said noise suppressor to the firearm with said flash suppressor received by said bore; and
threading said ring on said collar until said opening is eccentric relative to said bore at a second rotational position for causing said radial wall to block passage of said ring over said ridge.

73. The method according to claim 72, including:
releasably restraining said ring against rotation on said collar when said ring is at said first rotational position.

74. The method according to claim 72, including:
after the threading step, unthreading said ring on said collar until said ring is at said first rotational position; and
longitudinally withdrawing said noise suppressor from said flash suppressor.

75. The method according to claim 72, including:
releasably locking said ring against rotation on said collar when said ring is at said second rotational position.

76. The method according to claim 75, including:
unlocking said ring;
unthreading said ring on said collar until said ring is at said first rotational position; and
longitudinally withdrawing said noise suppressor from said flash suppressor.

77. The method according to claim 76, including:
after the unthreading step, releasably restraining said ring against rotation on said collar.

78. A method of attaching an auxiliary device to the barrel of a firearm having a longitudinal axis, comprising:
providing an annular ridge on a forward portion of the barrel;
providing an auxiliary device including a bore and a collar having a threaded outer surface eccentric about said bore, and a ring having an annular wall threaded onto said outer surface of said collar, said ring including a radial wall having a circular opening eccentric relative to said annular wall;
rotating said ring on said collar until said opening is concentric relative to said bore at a first rotational position of said ring for permitting said ring to pass over said ridge;
placing said auxiliary device to the firearm with said forward portion of said barrel received by said bore; and threading said ring on said collar until said opening is eccentric relative to said bore at a second rotational position for causing said radial wall to block passage of said ring over said ridge.

79. The method according to claim 78, including:

releasably restraining said ring against rotation on said collar when said ring is at said first rotational position.

80. The method according to claim 78, including:

after the threading step, unthreading said ring on said collar until said ring is at said first rotational position; and longitudinally withdrawing said auxiliary device from the forward portion of the barrel.

81. The method according to claim 78, including:

releasably locking said ring against rotation on said collar when said ring is at said second rotational position.

82. The method according to claim 81, including:

unlocking said ring;

unthreading said ring on said collar until said ring is at said first rotational position; and longitudinally withdrawing said auxiliary device from the forward portion of the barrel.

83. The method according to claim 82, including:

after the unthreading step, releasably restraining said ring against rotation on said collar.

84. The apparatus according to claim 1, wherein:

said noise suppressor and said fixture include interacting parts preventing rotation of said noise suppressor with respect to the barrel when said fixture is received by said bore.

85. The apparatus according to claim 19, wherein:

said noise suppressor and said fixture include interacting parts preventing rotation of said noise suppressor with respect to the barrel when said fixture is received by said bore.

86. The apparatus according to claim 37, wherein:

said auxiliary device and said fixture include interacting parts preventing rotation of said auxiliary device with respect to the barrel when said fixture is received by said bore.

87. The apparatus according to claim 51, wherein:

said auxiliary device and said fixture include interacting parts preventing rotation of said auxiliary device with respect to the barrel when said fixture is received by said bore.

* * * * *